US010053952B2

(12) United States Patent
Van Dongen

(10) Patent No.: US 10,053,952 B2
(45) Date of Patent: Aug. 21, 2018

(54) METHOD OF SEALING A FRACTURE IN A WELLBORE AND SEALING SYSTEM

(71) Applicant: Maersk Olie og Gas A/S, Copenhagen O (DK)

(72) Inventor: Hans Johannes Cornelis Maria Van Dongen, Copenhagen K (DK)

(73) Assignee: MAERSK OIL OG GAS A/S, Copenhagen O (DK)

( * ) Notice: Subject to any disclaimer, the term of this patent is extended or adjusted under 35 U.S.C. 154(b) by 0 days.

(21) Appl. No.: 15/301,622

(22) PCT Filed: Mar. 3, 2015

(86) PCT No.: PCT/EP2015/054347
§ 371 (c)(1),
(2) Date: Oct. 3, 2016

(87) PCT Pub. No.: WO2015/132221
PCT Pub. Date: Sep. 11, 2015

(65) Prior Publication Data

US 2017/0044863 A1 Feb. 16, 2017

(30) Foreign Application Priority Data

Mar. 3, 2014 (GB) ..... 1403675

(51) Int. Cl.
*E21B 43/26* (2006.01)
*E21B 33/138* (2006.01)
(Continued)

(52) U.S. Cl.
CPC ..... *E21B 33/138* (2013.01); *E21B 43/08* (2013.01); *E21B 43/114* (2013.01); *E21B 43/12* (2013.01);
(Continued)

(58) Field of Classification Search
CPC .... E21B 33/138; E21B 43/114; E21B 47/065; E21B 47/101; E21B 47/1025; E21B 17/20; E21B 34/06
(Continued)

(56) References Cited

U.S. PATENT DOCUMENTS 4,083,406 A * 4/1978 Metz ..... C09K 8/50 166/162
4,387,770 A 6/1983 Hill
(Continued)

FOREIGN PATENT DOCUMENTS

EP 1184537 B1 11/2005
WO 2003042496 A1 5/2003
WO 2010057931 A1 5/2010

OTHER PUBLICATIONS

International Search Report and Written Opinion for PCT/EP2015/054347, dated Jan. 11, 2016.
(Continued)

*Primary Examiner* — Silvana C Runyan
(74) *Attorney, Agent, or Firm* — Brinks Gilson & Lione

(57) ABSTRACT

In a method of sealing a fracture (1) in a formation (2) surrounding a wellbore provided with a non-cemented perforated liner (4), a placement tool (6) is introduced into the liner and so positioned that a sealing fluid outlet (7) of the placement tool is located at the fracture (1). A placement section (8) including the sealing fluid outlet is pressed against the liner. A placement fluid is caused to flow into the fracture and controlled to obtain a desired fluid flow in an annular space (5) between the liner and the formation that is directed in downstream direction at a position upstream the fracture and that is directed in upstream direction at a position downstream the fracture. When said desired flow is
(Continued)

Figure 1:
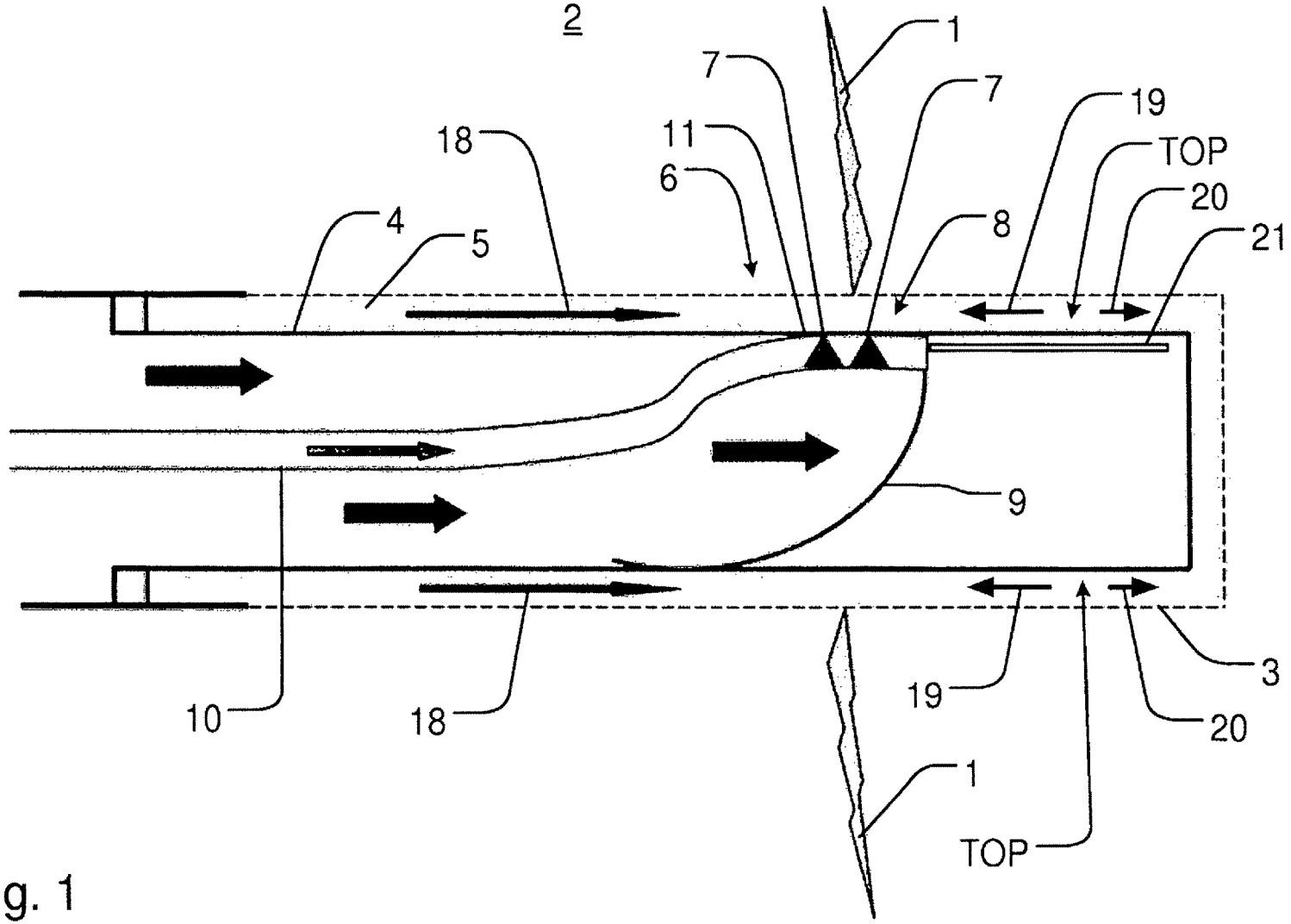

obtained, sealing fluid is ejected from the sealing fluid outlet. A sealing system is furthermore disclosed.

20 Claims, 3 Drawing Sheets

(51) Int. Cl.

| | |
|---|---|
| ***E21B 47/10*** | (2012.01) |
| ***E21B 47/12*** | (2012.01) |
| ***E21B 43/08*** | (2006.01) |
| ***E21B 43/114*** | (2006.01) |
| ***E21B 43/12*** | (2006.01) |
| ***E21B 47/06*** | (2012.01) |
| *E21B 17/20* | (2006.01) |
| *E21B 34/06* | (2006.01) |

(52) U.S. Cl.
CPC ..... *E21B 43/26* (2013.01); *E21B 47/065* (2013.01); *E21B 47/101* (2013.01); *E21B 47/1025* (2013.01); *E21B 47/123* (2013.01); *E21B 17/20* (2013.01); *E21B 34/06* (2013.01)

(58) Field of Classification Search
USPC ..... 166/285
See application file for complete search history.

(56) References Cited

U.S. PATENT DOCUMENTS

| | | | | |
|---|---|---|---|---|
| 4,809,780 | A | 3/1989 | Shen | |
| 4,842,068 | A | 6/1989 | Vercaemer et al. | |
| 5,002,127 | A | 3/1991 | Dalrymple et al. | |
| 5,697,441 | A | 12/1997 | Vercaemer et al. | |
| 7,640,983 | B2 | 1/2010 | Hilleary et al. | |
| 2005/0109508 | A1* | 5/2005 | Vella | E21B 33/14 166/297 |
| 2008/0196897 | A1* | 8/2008 | Nguyen | C09K 8/502 166/295 |
| 2013/0312963 | A1 | 11/2013 | Larsen et al. | |
| 2015/0267500 | A1* | 9/2015 | Van Dongen | E21B 33/13 277/336 |

OTHER PUBLICATIONS

Preliminary Report on Patentbility for PCT/EP2015/054347, dated Sep. 6, 2016.
Search report for Great Britain Application No. GB1403675.0, dated Sep. 9, 2014.

* cited by examiner

METHOD OF SEALING A FRACTURE IN A WELLBORE AND SEALING SYSTEM

RELATED APPLICATIONS

This application claims the benefit under 35 U.S.C. § 371 of the filing date of International Patent Application No. PCT/EP2015/054347, having an international filing date of Mar. 3, 2015, which claims priority to Great Britain Application No. 1403675.0, filed Mar. 3, 2014, the contents of both of which are incorporated herein by reference in their entirety.

The present invention relates to a method of sealing a fracture or thief zone in a formation of a hydrocarbon reservoir surrounding a wellbore section of a wellbore having an upstream direction and a downstream direction, the wellbore section being provided with a non-cemented perforated liner, thereby forming an at least substantially annular space between the non-cemented perforated liner and the formation.

Recovery of hydrocarbons from subsurface reservoirs involves the drilling of one or more wells to the depth of the hydrocarbon reservoir. After well completion, the reservoir can be drained for hydrocarbon fluids that are transported to the surface.

The reservoir typically has different zones with different permeability. If the permeability of one zone is higher than the average permeability in the rest of the reservoir, it may be referred to as a so-called thief zone.

Thief zones are common in hydrocarbon reservoirs and may increase the risk of a production well producing large volumes of water if such thief zone connects a production well to a source of water. Fluid can also flow via fractures in the reservoir.

A problem frequently encountered in wells intended for water injection is channeling of substantial quantities of water from an injection well to production wells, caused by the existence of natural or manmade thief zones in the form of channels or fractures in the reservoir.

Consequently, much effort has gone into developing methods and products that reduce the negative impact of such thief zones, channels or fractures.

Thief zones are normally sealed off by injecting a sealing fluid into the relevant part of the formation. The sealing fluid may, according to prior art solutions, simply be applied under pressure in the vicinity of a known thief zone or fracture and will then follow the track of least resistance into the thief zone or fracture. However, this solution is not feasible in connection with non-cemented perforated liner, as the sealing fluid may travel along the liner in the annular space formed between the non-cemented perforated liner and the formation. Thereby, it could happen that parts of the formation not constituting a thief zone or fracture would be plugged by the sealing fluid, thereby negatively influencing the well.

A specific type of non-cemented perforated liner is the so-called Controlled Acid Jet (CAJ) liner. These liners have a perforation optimized for acid stimulation of a well, and may subsequently to acid stimulation be used for water injection or oil production. A CAJ liner typically has a hole distribution whereby the total hole area per length unit of the liner increases from the heel (the inner part of the wellbore) to the toe (the outer part of the wellbore). Thereby, efficient acid stimulation of the complete wellbore section may be achieved, as the hole distribution may compensate for the pressure loss along the wellbore. A CAJ liner is described in EP 1 184 537 B1 (Maersk Olie og Gas A/S).

U.S. Pat. No. 4,842,068 discloses a method for selectively treating a subterranean formation without affecting or being affected by the two adjacent zones (above and below). Using this process, the treatment fluid is injected into the formation to be treated, at the same time as two protection fluids are injected into the two adjacent zones (above and below). The process can be applied even in the presence of fractures, gravel-pack and their zones. However, this method may be unsuitable in a wellbore provided with a non-cemented perforated liner, and specifically unsuitable in a wellbore provided with a (CAJ) liner as described above. The limited number of holes in a non-cemented perforated liner may prevent proper distribution of the protection fluids. Therefore, accurate sealing of thief zones or fractures may not be possible by use of this method.

The object of the present invention is to provide a method of sealing a fracture or thief zone in a formation surrounding a wellbore section provided with a non-cemented perforated liner without negatively influencing the remaining part of the wellbore section.

In view of this object, a placement tool is introduced into the non-cemented perforated liner and so positioned in the longitudinal direction of the wellbore section that a sealing fluid outlet of the placement tool is located at the fracture or thief zone in the formation, a placement section including the sealing fluid outlet is pressed against the wall of the non-cemented perforated liner, a placement fluid, such as sea water, is caused to flow into the fracture or thief zone in the formation by injection of placement fluid into the non-cemented perforated liner in the downstream direction so that placement fluid flows out through perforations of the non-cemented perforated liner and/or by production from an adjacent wellbore in the formation, the placement fluid injection and/or the production in the adjacent wellbore is controlled to obtain a desired fluid flow in the at least substantially annular space between the non-cemented perforated liner and the formation that is directed in downstream direction at a position upstream the fracture or thief zone and that is directed in the upstream direction at a position downstream the fracture or thief zone, and, when said desired fluid flow is obtained, sealing fluid is ejected from the sealing fluid outlet into the formation.

In this way, the sealing fluid may be guided and/or carried into the fracture or thief zone by means of a current created by the injected placement fluid, such as sea water, or created by the suction pressure in the adjacent wellbore, said current being formed in the at least substantially annular space between the non-cemented perforated liner and the formation and being directed at the fracture or thief zone from both upstream and downstream sides. Thereby, proper placement of the sealing fluid in the fracture or thief zone may be obtained even by limited access through the perforations of the liner, and the remaining part of the wellbore section may thereby be protected from the sealing fluid by the current created by the placement fluid.

In an embodiment, before ejection of sealing fluid, one or more supplemental apertures are created in the non-cemented perforated liner. Thereby, even better placement of the sealing fluid may be ensured, as a larger throughput area for the sealing fluid at the position of the fracture or thief zone may facilitate accurate and unrestricted flow of the sealing fluid in a proper direction. In an embodiment, the one or more supplemental apertures are created by means of directing a fluid jet against the wall of the liner. The perforation tool may be included by the placement tool.

In an embodiment, before ejection of sealing fluid, one or more supplemental apertures are created by means of a jetting tool, and the sealing fluid is subsequently ejected through the jetting tool, the jetting tool thereby being included by the placement section and forming the sealing fluid outlet of the placement tool. Thereby, once the jetting tool is positioned at the fracture or thief zone next to the wall of the liner, it may be used to firstly create one or more supplemental apertures in the liner and subsequently eject sealing fluid out through said apertures of the liner, without moving the jetting tool. Thereby, it may be ensured that the sealing fluid is ejected precisely out through the aperture or apertures created, because the sealing fluid outlet is already in the correct position when the sealing fluid is to be ejected out through said aperture or apertures. Thereby, it may even better be ensured that the remaining part of the wellbore section is protected from the sealing fluid.

In an embodiment, the placement tool includes an elongated body having a smaller diameter than the internal diameter of the non-cemented perforated liner, the elongated body is composed by mutually articulated sections and/or is elastic deformable, and the elongated body is pressed against the inner wall of the liner in a zigzag fashion when pressing the placement section against the wall of the non-cemented perforated liner. Thereby, the elongated body may be fixed securely in place in the liner during creation of the one or more supplemental apertures by means of the jetting tool, and during the subsequent ejection of sealing fluid through the jetting tool. Thereby, it may be even better ensured that the sealing fluid is ejected precisely out through the aperture or apertures created and thereby even better ensured that the remaining part of the wellbore section is protected from the sealing fluid.

In an embodiment, the placement fluid injection is controlled to obtain said desired fluid flow by controlling a placement fluid inflow rate at an upstream position of the wellbore section. Thereby, the desired fluid flow and thereby a proper placement of the sealing fluid in the fracture or thief zone may be achieved for instance by controlling the pumping rate of a pump placed above the wellbore. The pumping rate may be controlled on the basis of a comparison of a registered fluid flow and said desired fluid flow in the at least substantially annular space between the non-cemented perforated liner and the formation.

For instance, if the fluid flow in the at least substantially annular space between the non-cemented perforated liner and the formation is directed in the downstream direction at a position downstream the fracture or thief zone, this may be an indication that the fluid inflow rate is too low, and this rate may therefore be increased in order to reverse said fluid flow.

In an embodiment, additionally or alternatively, the production in an adjacent wellbore is controlled to obtain said desired fluid flow by controlling a fluid outflow rate at an upstream position of the adjacent wellbore.

In an embodiment, the placement fluid injection and/or the production in an adjacent wellbore is controlled during sealing fluid ejection in order to maintain said desired fluid flow. Thereby, the placement fluid injection and/or the production in an adjacent wellbore may gradually be adapted to the decreasing permeability of the fracture or thief zone as more and more sealing fluid is located in the fracture or thief zone. For instance, the placement fluid inflow rate and/or the production outflow rate in an adjacent wellbore may be decreased during sealing fluid ejection in order to maintain a placement fluid flow in the at least substantially annular space between the non-cemented perforated liner and the formation that is directed in the upstream direction at a position downstream the fracture or thief zone.

In an embodiment, sealing fluid ejection is terminated when said desired fluid flow cannot be maintained. Thereby, it may be ensured that the sealing fluid ejection may be continued until a suitable low permeability of the fracture or thief zone is obtained.

In an embodiment, said desired fluid flow is detected by detection and/or surveillance of a turn over point (TOP), at which flow directions diverge into upstream and downstream directions, respectively, in the at least substantially annular space, in a section of the liner located downstream the fracture or thief zone in the formation. The presence of a turn over point may indicate the presence of a fluid flow in the at least substantially annular space that is directed in the upstream direction at a position downstream the fracture or thief zone, and thereby, the presence of said desired fluid flow. Furthermore, surveillance of the movement of the turn over point in the direction of the wellbore may assist in controlling the placement fluid injection during sealing fluid ejection in order to maintain said desired fluid flow as will be described in further detail below.

In an embodiment, the placement fluid injection is controlled during sealing fluid ejection as a function of the actual position of the turn over point (TOP) in the longitudinal direction of the wellbore section. Thereby, said desired fluid flow may be maintained as long as the sealing fluid ejection takes place, thereby gradually adapting the placement fluid injection to the decreasing permeability of the fracture or thief zone as more and more sealing fluid is located in the fracture or thief zone. Thereby, the placement fluid inflow rate may be decreased during sealing fluid ejection. By doing this, it may furthermore be ensured that the pressure in the fracture or thief zone is not increased to levels that could lead to the formation breaking up whereby the fracture could propagate or new fractures could be generated.

In an embodiment, the detection and/or surveillance of the turn over point (TOP) is performed by means of a distributed sensing system, such as a Distributed Temperature Sensing (DTS) system and/or a Distributed Acoustic Sensing (DAS) system, including an extended sensing body, such as a fibre optic cable, arranged in the section of the liner located downstream the fracture or thief zone in the formation. Thereby, a very accurate and reliable detection and/or surveillance may be achieved.

In an embodiment, the detection and/or surveillance of the turn over point (TOP) is performed by means of an extended array of sensors, such as a cable provided with a number of discrete sensors distributed over its length and arranged in the section of the liner located downstream the fracture or thief zone in the formation.

The present invention furthermore relates to a sealing system for sealing a fracture or thief zone in a formation of a hydrocarbon reservoir surrounding a wellbore section of a wellbore having an upstream direction and a downstream direction, the wellbore section being provided with a non-cemented perforated liner, thereby forming an at least substantially annular space between the non-cemented perforated liner and the formation.

The sealing system is characterised in that it includes a placement tool adapted to be introduced into the non-cemented perforated liner, in that the placement tool is preferably provided with a perforation tool adapted to create one or more supplemental apertures in the non-cemented perforated liner, in that the placement tool is provided with a placement section adapted to be pressed against the wall of the non-cemented perforated liner, in that the placement section includes a sealing fluid outlet, in that the sealing system includes a control system adapted to control injection of a placement fluid, such as sea water, into the non-cemented perforated liner in the downstream direction and/or to control production from an adjacent wellbore in the formation in order for placement fluid to flow into the fracture or thief zone in the formation, in that the control system is adapted to control the placement fluid injection and/or to control the production from the adjacent wellbore in the formation to obtain a desired fluid flow in the at least substantially annular space between the non-cemented perforated liner and the formation that is directed in downstream direction at a position upstream the fracture or thief zone and that is directed in the upstream direction at a position downstream the fracture or thief zone, in that the control system includes a flow detection system adapted to detect when said desired fluid flow is present, and in that the control system is adapted to initiate ejection of sealing fluid from the sealing fluid outlet into the formation when the flow detection system detects said desired fluid flow. Thereby, the above-mentioned features may be obtained.

In an embodiment, the placement section of the placement tool includes a jetting tool adapted to create one or more supplemental apertures in the non-cemented perforated liner, and the jetting tool is furthermore adapted to eject the sealing fluid, the jetting tool thereby forming the sealing fluid outlet of the placement tool. Thereby, the above-mentioned features may be obtained.

In an embodiment, the placement tool includes an elongated body composed by mutually articulated sections and/or being elastic deformable, and the elongated body is adapted to be pressed against the inner wall of the liner in a zigzag fashion in order to press the placement section against the wall of the non-cemented perforated liner. Thereby, the above-mentioned features may be obtained.

In an embodiment, the flow detection system is adapted to detect and/or survey of a turn over point (TOP), at which flow directions diverge into upstream and downstream directions, respectively, in the at least substantially annular space, in a section of the liner located downstream the fracture or thief zone in the formation. Thereby, the above-mentioned features may be obtained.

In an embodiment, the flow detection system includes a distributed sensing system, such as a Distributed Temperature Sensing (DTS) system and/or a Distributed Acoustic Sensing (DAS) system, including an extended sensing body, such as a fibre optic cable, adapted to be arranged in the section of the liner located downstream the fracture or thief zone in the formation, preferably attached to the placement tool. Thereby, the above-mentioned features may be obtained.

The invention will now be explained in more detail below by means of examples of embodiments with reference to the very schematic drawing, in which FIG. 1 illustrates a cross-sectional view through a wellbore section in a formation provided with a non-cemented perforated liner in which a placement tool of a sealing system has been inserted.

Figure 2:
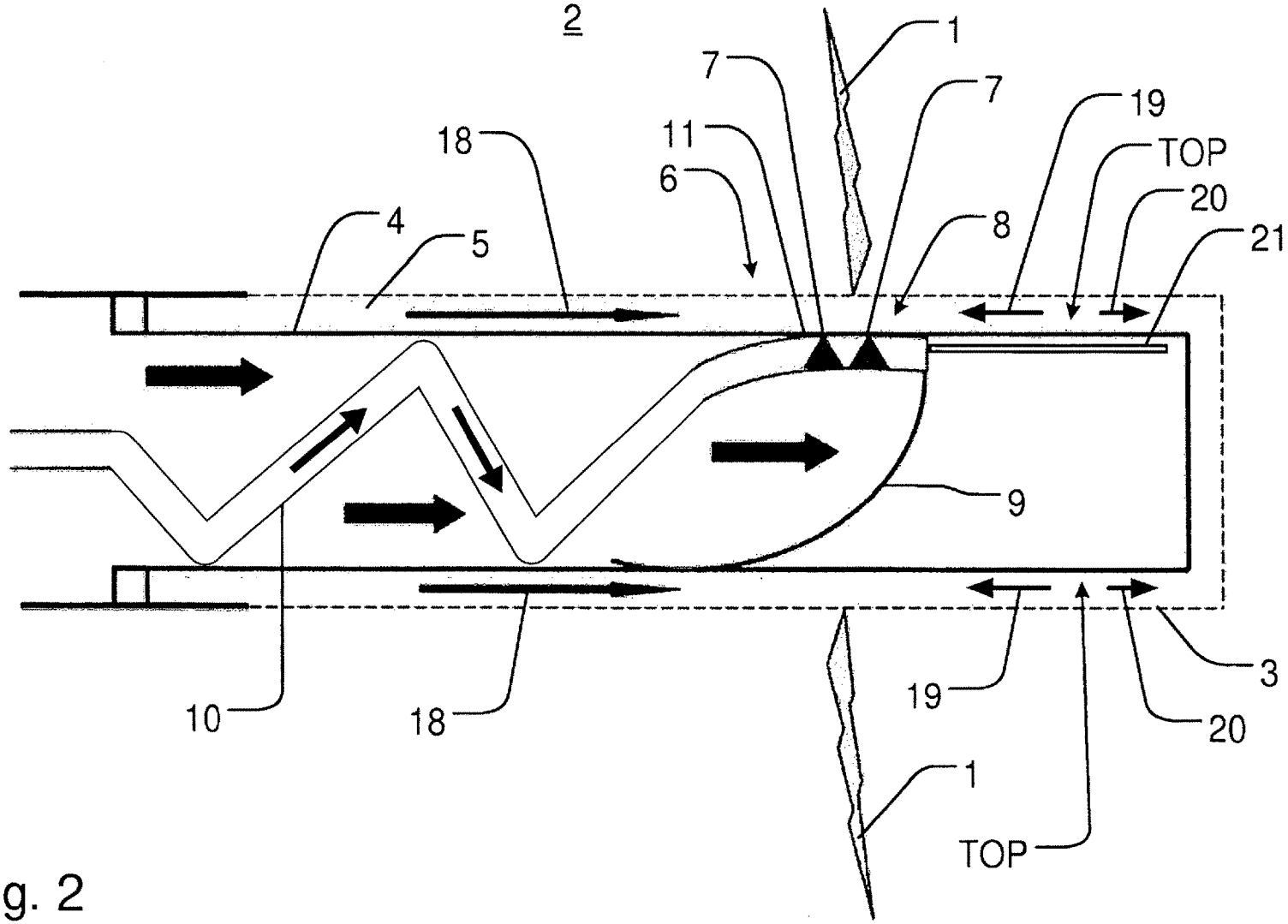
Figure 3:
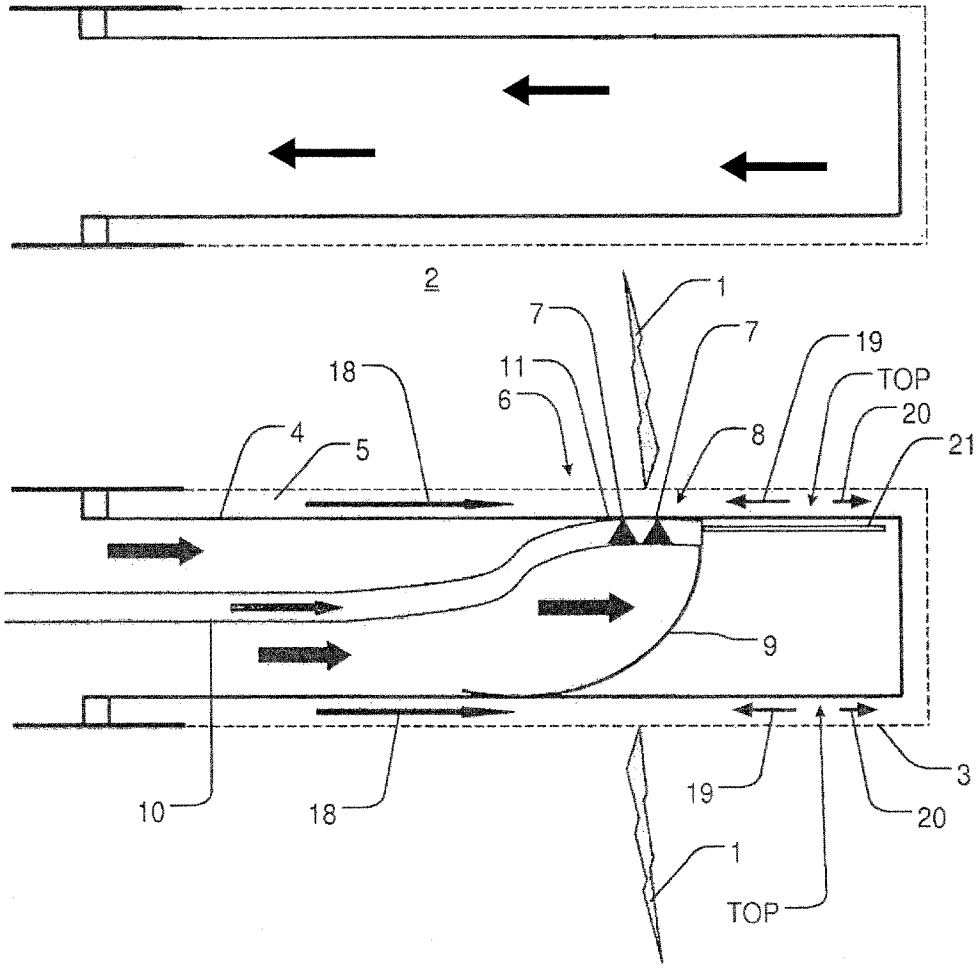

FIG. 2 illustrates a cross-sectional view through the wellbore section in which an elongated body of the placement tool is pressed against the inner wall of the liner in a zigzag fashion.

FIG. 2 illustrates a cross-sectional view through the wellbore section and an adjacent wellbore section through which a production fluid is produced.

FIG. 1 illustrates a method according to the invention of sealing a fracture or thief zone 1 in a formation 2 of a hydrocarbon reservoir surrounding a wellbore section 3 having an upstream or uphole direction from the right to the left in the FIGURE, and a downstream or downhole direction from the left to the right in the FIGURE. The wellbore section 3 is provided with a non-cemented perforated liner 4, thereby forming an at least substantially annular space 5 between the non-cemented perforated liner 4 and the formation 2. It is noted that the at least substantially annular space 5 behind the non-cemented perforated liner 4 is theoretically unobstructed, even though in practice, some dirt, rocks etc. may somewhat provide a noticeable obstruction at certain spaces.

The wellbore section 3 may extend from a heel (inner part) in downhole direction to a toe (outer part) of a wellbore or the wellbore section 3 may be part of a wellbore having a heel and a toe, wherein the remaining part of the wellbore may have any other suitable kind of completion, such as for instance in the form of a conventional cemented and perforated liner.

The non-cemented perforated liner 4 may, as mentioned above, typically have the form of a so-called CAJ liner having a limited perforation optimized for acid stimulation of a well. The liner may subsequently to acid stimulation be used for water injection or oil production. Prior art methods of sealing fractures or thief zones in a formation are not suitable when a non-cemented perforated liner is located in a wellbore, because the sealing fluid may travel along the liner in the at least substantially annular space formed between the non-cemented perforated liner and the formation.

According to the invention, a placement tool 6 is introduced into the non-cemented perforated liner 4 and so positioned in the longitudinal direction of the wellbore section 3 that a sealing fluid outlet 7 of the placement tool 6 is located at the fracture or thief zone 1 in the formation 2. The position of the fracture or thief zone 1 in the wellbore section may be determined by methods well-known in the art, such as for instance diagnostic instrumentation in the form of Distributed Temperature Sensing (DTS) and/or Distributed Acoustic Sensing (DAS).

Subsequently, a placement section 8 including the sealing fluid outlet 7 is pressed against the wall of the non-cemented perforated liner 4. In the illustration of the FIGURE, the placement section 8 is pressed against the upper part of the wall of the liner 4 by pressing a support arm 9 included by the placement tool 6 against the lower part of the wall of the liner 4.

The sealing fluid outlet 7 may be provided with a controllable valve in order to close the outlet when no sealing fluid has to be ejected. In the embodiment illustrated, the sealing fluid outlet 7 is supplied with sealing fluid via a coiled tubing 10 extending from a position above the wellbore at the surface of the formation 2, such as from a not shown wellhead. However, the sealing fluid outlet 7 may alternatively be supplied with sealing fluid from a downhole container.

As it may be seen in the FIGURE, the coiled tubing 10 has an outer cross-sectional dimension or diameter that is substantially smaller than the inner diameter of the non-cemented perforated liner 4. The coiled tubing 10 may preferably have an outer diameter that is smaller than ¼, preferably smaller than ⅕, and most preferred smaller than ⅐ of the inner diameter of the non-cemented perforated liner 4. The support arm 9 may likewise take up a very small part of the cross-sectional area inside the non-cemented perforated liner 4. Therefore, according to the embodiment illustrated, a placement fluid pumped into the liner 4, as described in more detail below, will be able to flow substantially unrestricted through the liner 4, also at the position where the placement tool 6 is located. This may indeed be of advantage in order to obtain a desired fluid flow in the liner 4, as described further below. The support arm 9 may have any suitable configuration in order to support the placement tool 6 at a position inside the non-cemented perforated liner 4 so that the placement section 8 may be suitably pressed against the wall of the non-cemented perforated liner 4 and so that the sealing fluid outlet 7 may thereby be positioned close to or touching the wall of the liner 4. Suitably, the sealing fluid outlet 7 may be positioned less than 5 mm, preferably less than 3 mm, and most preferred less than 1 mm, from the wall of the liner 4.

The support arm 9 may for instance have the form of an expandable, possibly elastic arm, adapted to be expanded from the placement tool 6 when the latter is positioned at the fracture or thief zone 1 in the liner 4. The support arm 9 may for instance have the form of a bowspring or powered decentralizing arm as a hold-down device. Alternatively, the placement section 8 may have the form of an expandable, possibly elastic arm, adapted to be expanded from the placement tool 6. In this case, the placement tool 6 itself or a part thereof may abut the wall of the liner opposite or at a different position than the position where the placement section 8 abuts the liner 4.

In an embodiment, the placement tool 6 includes an elongated body having a smaller outer diameter than the internal diameter of the non-cemented perforated liner, and the elongated body is composed by mutually articulated sections and/or is elastic deformable. Thereby, the elongated body may be adapted to be pressed against the inner wall of the liner 4 in a zigzag fashion so that the elongated body is fixed or substantially fixed inside the liner 4 when pressing the placement section 8 against the wall of the non-cemented perforated liner 4. An example of a suitable commercially available tool for this purpose is the HydraFlex (Registered Trademark) anchor. The HydraFlex anchor will for instance easily operate (fix itself) in liners having a diameter larger than 35.6 cm (14") while still being able to go through a production tubing opening having a diameter of 9.1 cm (3.6").

The elongated body may be composed by mutually articulated sections forming a hose or tube that may bend in a zigzag fashion when an internal pressure is applied, for instance by means of a fluid supplied to a jetting tool, as described below. In order to obtain this, the mutually articulated sections may for instance be adapted to form a certain mutual angle when a certain internal pressure is applied, but to be able to flex in relation to each other, when a lower pressure is applied. Any other suitable configuration enabling the elongated body to take up a zigzag form may be possible.

Preferably, the elongated body is composed by mutually articulated sections and/or is elastic deformable and is adapted to be either in a flexible state, whereby it is able to be introduced through a restriction having a certain internal restriction diameter, or to be in zigzag state, whereby it bends in a zigzag fashion as described above and is thereby able to fix itself inside a liner 4 having a certain internal liner diameter. Preferably, the elongated body is so adapted that said internal restriction diameter may be less than 50 percent, preferably less than 40 percent, and most preferred less than 30 percent of said internal liner diameter.

The sealing fluid may be ejected out through the existing perforations of the liner 4. Alternatively, before ejection of sealing fluid, one or more not shown supplemental apertures may be created, preferably by means of a perforation tool included by the placement tool 6, in the non-cemented perforated liner 4 at the position of the fracture or thief zone 1 in the formation 2. Thereby, a larger throughput area for the sealing fluid at the position of the fracture or thief zone may facilitate accurate and unrestricted flow of the sealing fluid in a proper direction. The one or more supplemental apertures may, subsequently to sealing of the fracture or thief zone, be plugged by sealing fluid. Furthermore, subsequently to sealing of the fracture or thief zone 1 in the formation 2, by means of sealing fluid ejection, a ring-formed plug may be formed in the at least substantially annular space 5 between the non-cemented perforated liner 4 and the formation 2.

The one or more supplemental apertures may preferably be created by means of directing a fluid jet against the wall of the liner 4 by means of a jetting tool 11, such as for instance the commercially available HydraJet®. The fluid jet may include common proppants. If needed, soluble abrasives, such as for instance the commercially available HydraBrade® can be used.

According to an advantageous embodiment, the sealing fluid is subsequently ejected through the jetting tool 11, the jetting tool 11 thereby being included by the placement section 8 and forming the sealing fluid outlet 7 of the placement tool 6. Thereby, once the jetting tool 11 is positioned at the fracture or thief zone 1 next to the wall of the liner 4, it may be used to firstly create one or more supplemental apertures in the liner 4 and subsequently eject sealing fluid out through said apertures of the liner, without moving the jetting tool 11. Thereby, it may be ensured that the sealing fluid is ejected precisely out through the aperture or apertures created, because the sealing fluid outlet 7 is already in the correct position when the sealing fluid is to be ejected out through said aperture or apertures. Thereby, it may even better be ensured that the remaining part of the wellbore section 3 is protected from the sealing fluid. The jetting tool 11 may incorporate a seal around the sealing fluid outlet 7, in order to minimize mixing of placement fluid and sealing fluid.

Injection of the sealing fluid may be done using the known SurgiFrac® Bernoulli sealing process; i.e., sealing dynamically using velocity. This means that the sealing fluid (conformance fluids) are being injected through the jetting tool 11 also.

Before the ejection of sealing fluid is initiated, a placement fluid, such as sea water or brine, is injected into the non-cemented perforated liner 4 in the downstream direction. Suitably, the placement fluid may be pumped down into the wellbore section 3 from a position above the formation 2, such as at a wellhead. However, a pump may be located at any suitable position along the wellbore.

Thereby, it is obtained that placement fluid flows out through perforations of the non-cemented perforated liner 4 and into the fracture or thief zone 1 in the formation 2. In FIG. 1, the perforations of the non-cemented liner 4, through which placement fluid flows, are not indicated; however, it should be understood that perforations are distributed over the entire length of the liner 4, so that placement fluid flows into the at least substantially annular space 5 between the non-cemented perforated liner 4 and the formation 2 and thereby may form a desired fluid flow as indicated by the arrows 18, 19, 20 in the FIGURE.

The desired fluid flow in the at least substantially annular space 5 between the non-cemented perforated liner 4 is, as indicated by the arrows 18, directed in downstream direction at a position upstream the fracture or thief zone 1, and, as indicated by the arrows 19, directed in the upstream direction at a position downstream the fracture or thief zone 1. Thereby, the sealing fluid may be guided and/or carried into the fracture or thief zone 1 by means of a current created by the injected placement fluid, said current being formed in the at least substantially annular space 5 between the non-cemented perforated liner 4 and the formation 2 and being directed at the fracture or thief zone 1 from both upstream and downstream sides, and proper placement of the sealing fluid in the fracture or thief zone 1 may be obtained even by limited access through the perforations of the liner 4.

The injected placement fluid is preferably seawater, and should preferably be a fluid having a suitably low viscosity enabling the placement fluid to properly enter the fracture or thief zone 1 and thereby guide and/or carry the sealing fluid into the fracture or thief zone 1. A placement fluid having a viscosity corresponding to that of seawater will normally be suitable, and the viscosity should at least be lower, preferably 5, 10 or 20 times lower, than that of the sealing fluid.

Alternatively, or in addition to, injecting a placement fluid into the non-cemented perforated liner 4, fluid, such as hydrocarbons and/or water, may be produced from an adjacent wellbore in the formation in order to create the above-mentioned desired fluid flow. The desired fluid flow may be created in this way as a consequence of a pressure drop over the fracture or thief zone 1 in the formation 2 from the wellbore section 3 provided with the non-cemented perforated liner 4 to the adjacent wellbore from which fluid is produced. If placement fluid is not injected into the non-cemented perforated liner 4, but fluid is produced from the adjacent wellbore, wellbore fluids may flow, possibly predominantly from the formation in the toe section, of the wellbore section 3 to the fracture or thief zone 1.

If the fracture or thief zone 1 is not positioned next to the toe of the wellbore, there will, at least by injection of placement fluid, according to the desired fluid flow, also exist a fluid flow in the at least substantially annular space 5 directed in the downstream direction at a position further downstream the fracture or thief zone 1, as illustrated by the arrows 20. Thereby, a so-called Turn Over Point (TOP) is created, as indicated in the FIGURE, where the flows are separated into upstream and downstream directions, respectively. During ejection of sealing fluid and placement of the sealing fluid in the fracture or thief zone 1, as a result of the fracture or thief zone 1 being sealed gradually by the sealing fluid, thereby lowering the rate of placement fluid entering the fracture or thief zone 1, the turn over point, TOP, will travel in upstream direction, thereby approaching the fracture or thief zone 1. Detection of the actual position and movement of the turn over point may therefore form the basis of a flow detection system adapted to detect when said desired fluid flow is present, as described in further detail below.

In order to obtain said desired fluid flow in the at least substantially annular space 5, the placement fluid injection and/or the production in the adjacent wellbore is controlled by means of a not shown control system, such as a computer based control system.

When said desired fluid flow is obtained, sealing fluid is ejected from the sealing fluid outlet 7 into the formation 2. The ejection of sealing fluid may be controlled and initiated by the not shown control system based on a signal from the above mentioned flow detection system.

The placement fluid injection may be controlled to obtain said desired fluid flow by controlling a placement fluid inflow rate at an upstream position of the wellbore section 3, for instance by means of a not shown pump positioned above the formation 2. The placement fluid injection may alternatively or additionally be controlled to obtain said desired fluid flow by controlling a flow rate at a position of the wellbore section 3 downstream the fracture or thief zone 1 in relation to the placement fluid inflow rate at an upstream position of the wellbore section 3.

For instance, the wellbore section 3 downstream the fracture or thief zone 1 may be provided with a not shown pump, whereby the flow rate in downstream direction at that position may be increased or even decreased. The pump may for instance be an Electrical Submersible Pump (ESP) with a Variable Speed Drive (VSD). Such a pump may also be positioned upstream the fracture or thief zone 1, if suitable, either instead or in addition to a pump positioned above the formation 2. Thereby, the relation between the rate of placement fluid supplied to the non-cemented perforated liner 4 in the section of the wellbore 3 located upstream and downstream the fracture or thief zone 1, respectively, may be controlled, so that said desired fluid flow may be obtained. The pump or pumps may be controlled on the basis of measurements performed by the flow detection system, and communicated via cable communication link to surface and/or with a not shown downhole local control unit.

Furthermore, the placement fluid injection may be controlled during sealing fluid ejection in order to maintain said desired fluid flow as long as the sealing fluid ejection takes place, thereby gradually adapting the placement fluid injection to the decreasing permeability of the fracture or thief zone as more and more sealing fluid is located in the fracture or thief zone. Thereby, the placement fluid inflow rate may be decreased during sealing fluid ejection. By doing this, it may furthermore be ensured that the pressure in the fracture or thief zone 1 is not increased to levels that could lead to the formation breaking up whereby the fracture could propagate or new fractures could be generated. The limiting pressure level may be referred to as the fracture closure pressure (FCP). Finally, sealing fluid ejection is terminated when said desired fluid flow cannot be maintained. The placement fluid injection may for instance be controlled during sealing fluid ejection as a function of the actual position of the turn over point (TOP) in the longitudinal direction of the wellbore section 3. When the turn over point is about to reach or reaches the position of the fracture or thief zone 1, the sealing fluid ejection may suitably be terminated.

The production in an adjacent wellbore may be controlled to obtain said desired fluid flow by controlling a fluid outflow rate at an upstream position of the adjacent wellbore.

The flow detection system may be based on a distributed sensing system, such as a Distributed Temperature Sensing (DTS) system and/or a Distributed Acoustic Sensing (DAS) system. DTS systems are optoelectronic devices which measure temperatures by means of optical fibres functioning as linear sensors. Temperatures are recorded along the optical sensor cable, thus not at points, but as a continuous profile. DAS systems use fibre optic cables to provide distributed strain sensing. In DAS, the optical fibre cable becomes the sensing element and measurements are made, and in part processed, using an attached optoelectronic device. Such a system allows acoustic frequency strain signals to be detected over large distances and in harsh environments.

In FIG. 1, the placement tool 6 is provided with a fibre optic cable 21 forming part of a distributed sensing system included by the flow detection system of the sealing system according to an embodiment of the invention. The fibre optic cable 21 extends from the placement tool 6 in the downstream section of the liner 4, in the direction of the toe of the wellbore. The fibre optic cable 21 could for instance have a length of 100-200 meters, but the length may be adapted to the actual conditions.

By means of the fibre optic cable 21 forming part of a distributed sensing system, the actual position of the turn over point, TOP, along the length of the wellbore may be detected by temperature sensing and/or by acoustic sensing. This detection is possible, because variables, such as temperature and sound will change in the region of the turn over point, also inside the non-cemented perforated liner 4, where the fibre optic cable 21 may be located.

As explained above, as a result of the fracture or thief zone 1 being sealed gradually by the sealing fluid, the turn over point, TOP, will travel in upstream direction, thereby approaching the fracture or thief zone 1. Therefore, detection of the actual position and movement of the turn over point may assist or be the basis of a flow detection system adapted to detect when said desired fluid flow is present.

As an alternative to the fibre optic cable 21, an extended array of sensors may be used, such as a cable provided with a number of discrete sensors distributed over its length. Such sensors may be pressure sensors, temperature sensors, flow sensors, chemical sensors, optical sensors, pH sensors or any other suitable type of sensor or combination of sensor that may provide useful information about the fluid flow in the liner 4 and especially in the at least substantially annular space 5.

In an embodiment, the sealing fluid includes a water swelling polymer carried by a carrier fluid. CrystalSeal® is an example of a suitable commercially available water-swellable synthetic polymer capable of absorbing up to 400 times its own weight in sweet water. The rate of absorption can be controlled based on the particle size and carrier fluid.

Preferably, the carrier fluid at least partially inhibits the swelling of the water swelling polymer. In the case of CrystalSeal, a suitable carrier fluid is a high salinity fluid or a hydrocarbon-based fluid.

Other types of sealing fluid may be employed, such as for instance epoxy resins and elastomers or crosslinked, non-damaging derivati natural polymers, among others, depending on the actual conditions.

The method according to the invention of sealing a fracture or thief zone 1 in a formation 2 may be repeated one or more times before or during acid stimulation and/or before or during stimulation or production.

The invention claimed is:

1. A method of sealing a fracture or thief zone in a formation of a hydrocarbon reservoir surrounding a wellbore section of a wellbore having an upstream direction towards a top opening of the wellbore and a downstream direction towards a bottom end of the wellbore, the method comprising:

providing the wellbore section with a non-cemented perforated liner, thereby forming an at least substantially annular space between the non-cemented perforated liner and the formation;

positioning a placement tool into the non-cemented perforated liner in the longitudinal direction of the wellbore section so that a sealing fluid outlet of the placement tool is located at the fracture or thief zone in the formation;

pressing a placement section of the placement tool that includes the sealing fluid outlet against an inner wall of the non-cemented perforated liner;

causing a placement fluid to flow into the fracture or thief zone in the formation by injecting placement fluid into the non-cemented perforated liner in the downstream direction so that placement fluid flows out through perforations of the non-cemented perforated liner or by drawing the placement fluid into an adjacent wellbore in the formation as a production fluid;

controlling the injection of the placement fluid or production of the production fluid in the adjacent wellbore to obtain a desired fluid flow in the at least substantially annular space between the non-cemented perforated liner and the formation, wherein the desired flow of the placement fluid occurs when the placement fluid flows in a downstream direction at a position upstream the fracture or thief zone and an upstream direction at a position downstream the fracture or thief zone; and when said desired fluid flow is obtained, ejecting sealing fluid from the sealing fluid outlet into the formation.

2. The method according to claim 1, wherein before ejecting the sealing fluid, the method comprises:

directing a fluid jet against the inner wall of the liner via a perforation tool included with the placement tool to thereby create one or more supplemental apertures in the non-cemented perforated liner.

3. The method according to claim 1, wherein the placement section includes a jetting tool with and outlet that corresponds to the sealing fluid outlet of the placement tool, wherein before ejecting the sealing fluid, the method comprises:

creating one or more supplemental apertures with the jetting tool.

4. The method according to claim 3, whereby the placement tool includes an elongated body having a smaller outer diameter than an internal diameter of the non-cemented perforated liner, whereby the elongated body comprises mutually articulated sections or is elastic deformable, and whereby the elongated body is pressed against the inner wall of the liner in a zigzag fashion when pressing the placement section against the inner wall of the non-cemented perforated liner.

5. The method according to claim 1 comprising:

controlling a placement fluid inflow rate at an upstream position of the wellbore section to thereby control the placement fluid injection to obtain said desired fluid flow;

controlling a fluid outflow rate at an upstream position of the adjacent wellbore to thereby control the production in the adjacent wellbore to obtain said desired fluid flow;

maintaining said desired fluid flow during sealing fluid ejection; and terminating sealing fluid ejection when said desired fluid flow can no longer be maintained.

6. The method according to claim 1, wherein determining that said desired fluid flow can no longer be maintained comprises detecting a turn over point (TOP) at which flow directions diverge into upstream and downstream directions, respectively, in the at least substantially annular space, in a section of the liner located downstream from the fracture or thief zone in the formation.

7. The method according to claim 1, whereby the placement fluid injection is controlled during sealing fluid ejection as a function of an actual position of the turn over point (TOP) in the longitudinal direction of the wellbore section.

8. The method according to claim 6, whereby the detection of the turn over point (TOP) is performed by a distributed temperature sensing (DTS) system or a distributed acoustic sensing (DAS) system, wherein the DTS or DAS includes an fibre optic cable sensing body arranged in a section of the liner located downstream the fracture or thief zone in the formation.

9. The method according to claim 1, whereby the detection of the turn over point (TOP) is performed by a cable provided with a number of discrete sensors distributed over its length and arranged in a section of the liner located downstream the fracture or thief zone in the formation.

10. A sealing system for sealing a fracture or thief zone in a formation of a hydrocarbon reservoir surrounding a wellbore section of a wellbore having an upstream direction towards a top opening of the wellbore and a downstream direction towards a bottom end of the wellbore, the sealing system comprising:

a non-cemented perforated liner for placement in the wellbore section to thereby form an at least substantially annular space between the non-cemented perforated liner and the formation;

a placement tool adapted to be introduced into the non-cemented perforated liner, wherein the placement tool includes a perforation tool adapted to create one or more supplemental apertures in the non-cemented perforated liner, and a placement section, wherein the placement section includes a sealing fluid outlet and is adapted to be pressed against the wall of the non-cemented perforated liner; and a control system adapted to control injection of a placement fluid into the non-cemented perforated liner in the downstream direction or to control production of the placement fluid from an adjacent wellbore in the formation in order for placement fluid to flow into the fracture or thief zone in the formation, wherein:

the control system is adapted to control the placement fluid injection or to control the production from the adjacent wellbore in the formation to obtain a desired fluid flow in the at least substantially annular space between the non-cemented perforated liner and the formation, wherein the desired flow of the placement fluid occurs when the placement fluid flows in the downstream direction at a position upstream the fracture or thief zone and that is directed in the upstream direction at a position downstream the fracture or thief zone, the control system includes a flow detection system adapted to detect when said desired fluid flow is present, and the control system is adapted to initiate ejection of sealing fluid from the sealing fluid outlet into the formation when the flow detection system detects said desired fluid flow.

11. The sealing system according to claim 10, wherein the placement section of the placement tool includes a jetting tool adapted to create one or more supplemental apertures in the non-cemented perforated liner, and wherein the jetting tool is furthermore adapted to eject the sealing fluid, the jetting tool thereby forming the sealing fluid outlet of the placement tool.

12. The sealing system according to claim 10, wherein the placement tool includes an elongated body comprising mutually articulated sections or is elastic deformable, and wherein the elongated body is adapted to be pressed against the inner wall of the liner in a zigzag fashion in order to press the placement section against the wall of the non-cemented perforated liner.

13. The sealing system according claim 10, wherein the flow detection system is adapted to detect a turn over point (TOP) at which placement fluid flow directions diverge into upstream and downstream directions, respectively, in the at least substantially annular space, in a section of the liner located downstream the fracture or thief zone in the formation.

14. The sealing system according to claim 10, wherein the flow detection system includes a distributed temperature sensing (DTS) system or a distributed acoustic sensing (DAS) system, wherein the DTS or DAS includes a fiber optic cable sensing body adapted to be arranged in the section of the liner located downstream the fracture or thief zone in the formation, attached to the placement tool.

15. The method according to claim 2 comprising:

controlling a placement fluid inflow rate at an upstream position of the wellbore section to thereby control the production in the adjacent wellbore to obtain said desired fluid flow;

controlling a fluid outflow rate at an upstream position of the adjacent wellbore to thereby control the production in the adjacent wellbore to obtain said desired fluid flow maintaining said desired fluid flow during sealing fluid ejection; and terminating sealing fluid ejection when said desired fluid flow cannot be maintained.

16. The method according to claim 2, wherein determining that whereby said desired fluid flow can no longer be maintained comprises detecting a turn over point (TOP), at which flow directions diverge into upstream and downstream directions, respectively, in the at least substantially annular space, in a section of the liner located downstream from the fracture or thief zone in the formation.

17. The sealing system according claim 11, wherein the flow detection system is adapted to detect a turn over point (TOP) at which placement fluid flow directions diverge into upstream and downstream directions, respectively, in the at least substantially annular space, in a section of the liner located downstream the fracture or thief zone in the formation.

18. The sealing system according to claim 11, wherein the flow detection system includes a distributed temperature sensing (DTS) system and/or a distributed acoustic sensing (DAS) system, wherein the DTS or DAS includes a fiber optic cable sensing body, adapted to be arranged in the section of the liner located downstream the fracture or thief zone in the formation, attached to the placement tool.

19. The method according to claim 1, wherein the placement fluid corresponds to sea water.

20. The sealing system according to claim 10, wherein the placement fluid corresponds to sea water.

* * * * *